US005965466A

United States Patent [19]

Rodrigues et al.

[11] Patent Number: 5,965,466

[45] Date of Patent: Oct. 12, 1999

[54] METHOD FOR IMPARTING PERMANENT PRESS TO TEXTILES

[75] Inventors: Klein A. Rodrigues, Signal Mountain; Michael C. Hazlewood, Knoxville, both of Tenn.

[73] Assignee: National Starch and Chemical Investment Holding Corporation, Wilmington, Del.

[21] Appl. No.: 09/107,817

[22] Filed: Jun. 30, 1998

[51] Int. Cl.[6] ..... B32B 27/42; D06M 13/322

[52] U.S. Cl. ..... 442/107; 8/181; 8/185; 8/189; 442/163

[58] Field of Search ..... 442/107, 163; 8/181, 185, 189

[56] References Cited

U.S. PATENT DOCUMENTS 4,076,917 2/1978 Swift et al. ..... 526/49
4,127,382 11/1978 Perry ..... 8/181
4,300,898 11/1981 North ..... 8/185
4,332,586 6/1982 North ..... 8/186
5,858,549 1/1999 Kielbania, Jr. et al. ..... 428/474.4

*Primary Examiner*—Blaine Copenheaver
*Attorney, Agent, or Firm*—John D. Thallemar

[57] ABSTRACT

A method for imparting permanent press properties to a textile containing cellulose fibers. The method involves applying an aqueous solution of a (hydroxyalkyl)urea and/or a β-hydroxyalkyl amide crosslinking agent to a textile, and heating the textile at a sufficient temperature for a sufficient time to react the crosslinking agent with the textile wherein water is removed from the textile, to impart permanent press properties to the textile. The crosslinking agent is free of formaldehyde. The method of the present invention provides permanent press properties to textiles treated therewith and increases the resistance of such textiles to future laundering abrasion. Such treated textiles display a significant reduction in wrinkles compared with nontreated textiles. Moreover, the treated textiles have a tactile sensation of feeling soft and retain their smoothness after laundering.

22 Claims, 1 Drawing Sheet

METHOD FOR IMPARTING PERMANENT PRESS TO TEXTILES

FIELD OF THE INVENTION

This invention relates to a method for imparting permanent press properties to a textile. More specifically, the method involves applying an aqueous solution of a (hydroxyalkyl)urea or a β-hydroxyalkyl amide crosslinking agent to the textile.

BACKGROUND OF THE INVENTION

The use of thermosetting resins or reactants to impart crease resistance and dimensional stability to textile materials is well-known in the art. These materials, known as "aminoplast resins", include the products of the reaction of formaldehyde with such compounds as urea, thiourea, ethylene urea, dihydroxyethylene urea, melamines or the like. A serious drawback to the use of such materials is that they contain free formaldehyde. This is present during the preparation and storage of the finishing agent and its use in treating textiles, on the treated fabric, and on the finished garments. Also, when the fabrics or garments made therefrom are stored under humid conditions, additional free formaldehyde is produced.

The presence of even less than one percent of free formaldehyde, based on the total weight of the product, is undesirable, not only because of its unpleasant odor, but because it is an allergen and an irritant, causing severe reactions in the operators who manufacture the agent and who treat and handle the treated fabrics and to persons who handle and wear garments fabricated from the treated fabrics.

These problems associated with the presence of free formaldehyde on treated fabrics are well-known and considerable efforts have been made to produce formaldehyde-free textile fabrics. One solution to the problem has been to employ scavengers for the free formaldehyde. In U.S. Pat. No. 3,590,100 cyclic ethylene urea and propylene urea are disclosed as scavengers. Removal of the formaldehyde by reaction with phthalimide is disclosed in U.S. Pat. No. 3,723,058. U.S. Pat. No. 4,127,382 teaches certain nitrogen-containing heterocyclic compounds as scavengers.

U.S. Pat. No. 5,858,549 describes compositions containing a poly-functional molecule having at least two functional groups selected from carboxyl, anhydride and amine which is crosslinked using a (hydroxyalkyl)urea crosslinking agent. U.S. Pat. No. 5,858,549 does not teach or suggest reacting a (hydroxyalkyl)urea crosslinking agent with textiles such as cotton which contain hydroxyl functionality. U.S. Pat. No. 4,076,917 describes β-hydroxyalkylamides as curing agents for polymers containing one or more carboxy or anhydride functions.

Treating textiles with resin compositions that do not contain or evolve formaldehyde is also known, as in U.S. Pat. No. 3,260,565 which describes finishing agents formed by the reaction of alkyl or aryl ureas or thioureas with glyoxal. U.S. Pat. Nos. 4,332,586 and 4,300,898 describe alkylated glyoxal/cyclic urea condensates as crosslinking agents for textiles. U.S. Pat. No. 4,295,846 describes a finishing agent for textiles which is prepared by reacting urea or symmetrically disubstituted ureas in an aqueous solution with glyoxal. These agents, however, have the disadvantage of having marginal permanent press properties. Finishing agents formed by the reaction of ethylene urea with glyoxal are described in Japanese publication No. 5 3044-567, but they too do not have satisfactory properties.

Thus, there is a need for a formaldehyde-free crosslinking agent which is environmentally safe and provides permanent press to textiles. Such crosslinking agents should also allow consumers the ability to provide permanent press properties easily and cost-effectively to clothing at home.

SUMMARY OF THE INVENTION

Accordingly, it is an object of the invention to increase the resistance of a textile to laundering abrasion.

It is also an object of the invention to provide permanent press to textiles.

It is another object of the invention to provide permanent press to textiles using a formaldehyde-free crosslinking agent.

It is a further object of the invention to provide a formaldehyde-free crosslinking agent as a finishing agent in the manufacture of textiles.

It is an additional object of the invention to provide an environmentally safe and economical method for applying crease resistant properties to textiles in a convenient manner at a consumers place of residence.

With regard to the foregoing and other objects, the present invention provides a method for imparting permanent press properties to a textile containing cellulose fibers wherein said method comprises applying an aqueous solution of a formaldehyde-free crosslinking agent to a textile, and heating the textile at a sufficient temperature for a sufficient time to react the crosslinking agent with the textile wherein water is removed from the textile, to impart permanent press properties to the textile, wherein the crosslinking agent is selected from the group consisting of (hydroxyalkyl)urea, β-hydroxyalkylamide and combinations thereof, wherein the (hydroxyalkyl)urea has the structure

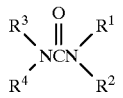

wherein $R^1$ is

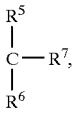

$R^2$ is H or $R^5$, $R^3$ is H or $R^5$, and $R^4$ is H, $R^1$, or $R^5$, wherein $R^5$ is $$H,\ CH_2OH,\ \overset{R^8\ R^9}{\overset{|\ \ |}{CHCHOH}},\ \overset{R^8\ R^9\ R^{10}}{\overset{|\ \ |\ \ |}{CHCHCHOH}}\ \text{or}\ C_1\text{–}C_4\ \text{alkyl},$$

$R^6$ is $$H,\ CH_2OH,\ \overset{R^8\ R^9}{\overset{|\ \ |}{CHCHOH}},\ \overset{R^8\ R^9\ R^{10}}{\overset{|\ \ |\ \ |}{CHCHCHOH}}\ \text{or}\ C_1\text{–}C_4\ \text{alkyl},$$

and $R^7$ is $$H,\ CH_2OH,\ \overset{R^8\ R^9}{\overset{|\ \ |}{CHCHOH}},\ \overset{R^8\ R^9\ R^{10}}{\overset{|\ \ |\ \ |}{CHCHCHOH}}\ \text{or}\ C_1\text{–}C_4\ \text{alkyl},$$

wherein $R^8$ is H, methyl or ethyl, $R^9$ is H, methyl or ethyl, and $R^{10}$ is H, methyl or ethyl; and the β-hydroxyalkylamide has the structure $$[HO(R^{13})_2C(R^{12})_2C-\underset{\underset{R^{11}}{|}}{N}-\overset{\overset{O}{\|}}{C}\,\underset{n}{]}-A-[\overset{\overset{O}{\|}}{C}-\underset{\underset{R^{11}}{|}}{N}-C(R^{12})_2C(R^{13})_2OH]_{n'}$$

wherein A is a bond, hydrogen, a monovalent or polyvalent organic radical derived from a saturated or unsaturated alkyl containing from 1 to 60 carbon atoms, aryl, tri-lower alkyleneamino or an ethylenically unsaturated radical; $R^{11}$ is selected from the group consisting of hydrogen, lower alkyl having 1 to 5 carbon atoms, and hydroxyalkyl having from 1 to 5 carbon atoms; $R^{12}$ and $R^{13}$ are independently selected from the group consisting of hydrogen, straight or branched chain lower alkyl having from 1 to 5 carbon atoms, and one of the $R^{12}$ and $R^{13}$ radicals joined together with the carbon atoms to which they are attached to form a cycloalkyl; n is an integer of 1 or 2 and n' is an integer of 0 to 2; n being 2 when n' is 0.

According to another aspect the invention provides a method for imparting permanent press properties to a textile containing cellulose fibers wherein said method comprises adding either an aqueous solution of a formaldehyde-free crosslinking agent or a neat formaldehyde-free crosslinking agent to a laundering process comprising at least one textile, and heating the textile at a sufficient temperature for a sufficient time to react the crosslinking agent with the textile wherein water is removed from the textile, to impart permanent press properties to the textile, wherein the crosslinking agent is selected from the group consisting of (hydroxyalkyl)urea, β-hydroxyalkylamide and combinations thereof.

The method of the present invention provides permanent press properties to textiles treated therewith and increases the resistance of such textiles to laundering abrasion. Such treated textiles display a significant reduction in wrinkles compared with nontreated textiles. Moreover, the treated textiles have a tactile sensation of feeling soft and retain their smoothness after laundering.

DESCRIPTION OF THE INVENTION

Figure 1:
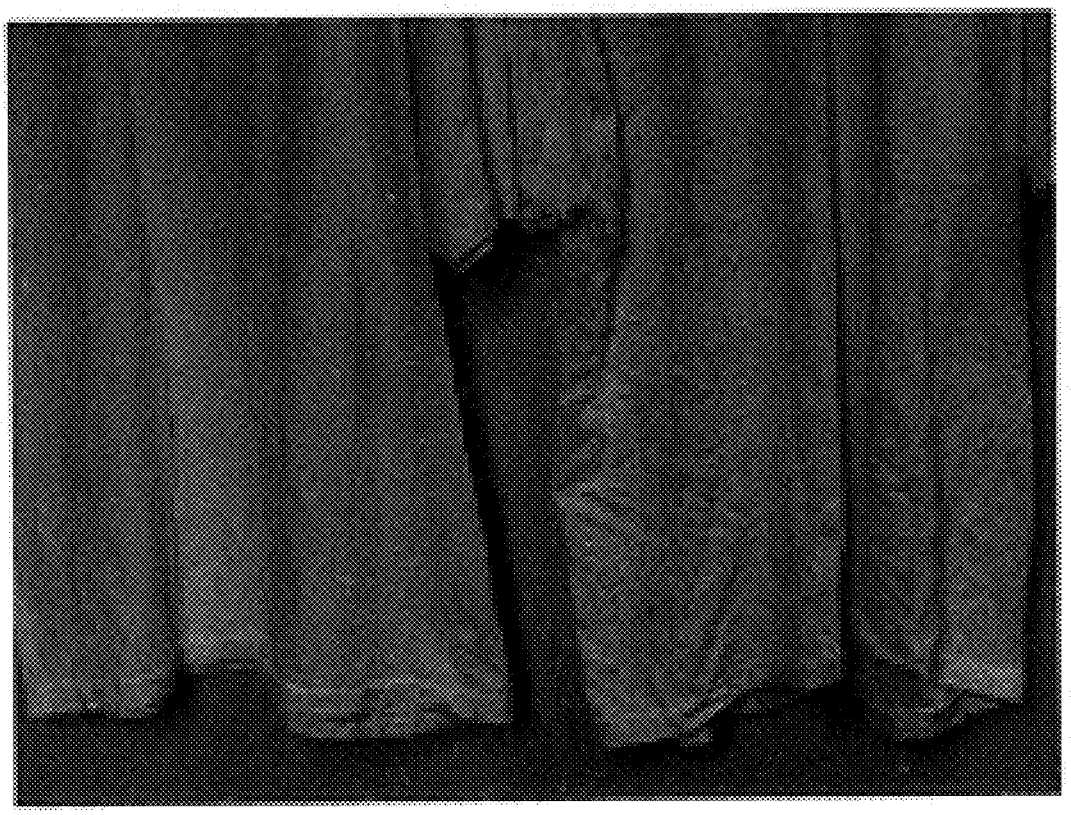
FIG. 1 is a photomicrograph of two T-shirts, the T-shirt on the left was treated with an aqueous solution containing the (hydroxyalkyl)urea crosslinking agent of the invention, and the T-shirt on the right was untreated.

This invention relates to a method for imparting permanent press properties to a textile containing cellulose fibers. As used herein, "permanent press" shall be synonymous with wrinkle resistance, durable press, dimensional stability, shrinkage resistance, and wrinkle recovery. The method involves applying an aqueous solution of a (hydroxyalkyl) urea or a β-hydroxyalkyl amide crosslinking agent to a textile, and heating the textile at a sufficient temperature for a sufficient time to react the crosslinking agent with the textile wherein water is removed from the textile, to impart permanent press properties to the textile. The crosslinking agent is essentially free of formaldehyde and may be applied in the form of an aqueous solution or neat.

The cellulosic textiles may be woven or non-woven fabrics and include 100% cellulosic fabrics, for example, cotton, rayon, and linen, as well as blends, for example, polyester/cotton or polyester/rayon. Such blends preferably contain at least 20% of cellulose. Both white and colored (printed, dyed, yarn-dyed, cross-dyed, etc.) fabrics can be effectively treated with the crosslinking agents of this invention. The textiles may comprise new or used clothing including previously worn clothing and/or laundered clothing. Preferably, the cellulosic textiles contain free hydroxyl groups.

The (hydroxyalkyl)urea crosslinking agent is derived from urea, comprise only a single urea group, at least two hydroxyl groups, at least two carbon atoms disposed between the urea group and each of the hydroxyl groups. The two carbons disposed between the hydroxyl and urea groups may be in linear, branched or substituted configuration. The (hydroxyalkyl)urea crosslinking agent is represented by structure (I) as follows:

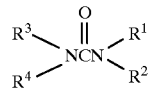

(I)

wherein $R^1$ is $$\overset{R^5}{\overset{|}{\underset{\underset{R^6}{|}}{C}}}-R^7,$$

$R^2$ is H or $R^5$, $R^3$ is H or $R^5$, and $R^4$ is H, $R^1$, or $R^5$, wherein $R^5$ is $$H,\ CH_2OH,\ \overset{R^8\ R^9}{\overset{|\ \ |}{CHCHOH}},\ \overset{R^8\ R^9\ R^{10}}{\overset{|\ \ |\ \ |}{CHCHCHOH}}\ \text{or}\ C_1\text{–}C_4\ \text{alkyl},$$

$R^6$ is $$H,\ CH_2OH,\ \overset{R^8\ R^9}{\overset{|\ \ |}{CHCHOH}},\ \overset{R^8\ R^9\ R^{10}}{\overset{|\ \ |\ \ |}{CHCHCHOH}}\ \text{or}\ C_1\text{–}C_4\ \text{alkyl},$$

and $R^7$ is $$H,\ CH_2OH,\ \overset{R^8\ R^9}{\overset{|\ \ |}{CHCHOH}},\ \overset{R^8\ R^9\ R^{10}}{\overset{|\ \ |\ \ |}{CHCHCHOH}}\ \text{or}\ C_1\text{–}C_4\ \text{alkyl},$$

wherein $R^8$ is H, methyl or ethyl, $R^9$ is H, methyl or ethyl, and $R^{10}$ is H, methyl or ethyl.

Preferred (hydroxyalkyl)urea crosslinking agents are N,N-bis(2-hydroxyethyl)urea, tetrakis(2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl) urea and 2-urea-2-ethyl-1,3-propanediol. Most preferably, the (hydroxyalkyl)urea crosslinking agent is N,N'-bis(2-hydroxyethyl)urea. Combinations of (hydroxyalkyl) urea crosslinking agents can also be used in the method of the invention.

The (hydroxyalkyl)urea crosslinking agent is the reaction product of urea and an alkanolamine with the evolution of ammonia. Preferably, the alkanolamines are, for example, diethanol amines such as 2-amino-2-methyl-1,3-propanediol, bis(hydroxymethyl)amino-methane, 2-methyl-3-amino-1-propanol and 2-methylaminoethanol. Processes for preparing the (hydroxyalkyl)urea crosslinking agent is described in U.S. patent application Ser. No. 08/783,350 which is hereby incorporated herein by reference.

The β-hydroxyalkyl amide crosslinking agent is represented by structure (II) as follows:

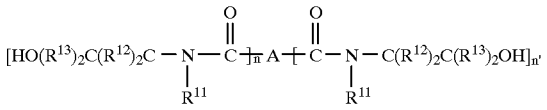

In structure (II), A is a bond, hydrogen or a monovalent or polyvalent organic radical derived from a saturated or unsaturated alkyl radical wherein the alkyl radical contains from 1 to 60 carbon atoms, such as methyl, ethyl, propyl, butyl, pentyl, hexyl, heptyl, octyl, nonyl, decyl, eicosyl, triacontyl, tetracontyl, pentacontyl, hexylcontyl and the like; aryl, for example, mono- and dinuclear aryl such as phenyl, naphthyl and the like; tri-lower alkyleneamino such as trimethyleneamino, triethyleneamino and the like; or an unsaturated radical containing one or more ethylenic groups such as ethenyl, 1-methylethenyl, 3-butenyl-1,3-diyl, 2-propenyl-1,2-diyl, carboxy lower alkenyl, such as 3-carboxy-2-propenyl and the like, lower alkoxy carbonyl lower alkenyl such as 3-ethoxycarbonyl-2-propenyl and the like; $R^{11}$ is hydrogen, lower alkyl of from 1 to 5 carbon atoms such as methyl, ethyl, n-propyl, n-butyl, sec-butyl, tert-butyl, pentyl and the like or hydroxy lower alkyl of from 1 to 5 carbon atoms such as hydroxyethyl, 3-hydroxypropyl, 2-hydroxypropyl, 4-hydroxybutyl, 3-hydroxybutyl, 2-hydroxy-2-methylpropyl, 5-hydroxypentyl, 4-hydroxypentyl, 3-hydroxypentyl, 2-hydroxypentyl and the isomers of pentyl; $R^{12}$ and $R^{13}$ are the same or different radicals selected from hydrogen, straight or branched chain lower alkyl of from 1 to 5 carbon atoms or one of the $R^{12}$ and one of the $R^{13}$ radicals may be joined to form, together with the carbon atoms, such as cyclopentyl, cyclohexyl and the like; n is an integer having a value of 1 or 2 and n' is an integer having a value of 0 to 2 or when n' is 0.

A preferred β-hydroxyalkyl amide crosslinking agent is represented by structure (III) as follows:

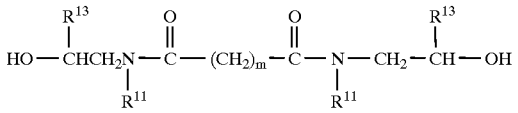

In structure (III), $R^{11}$ is H, lower alkyl, or $HO(R^{13})_2C(R^{12})_2C$—, n and n' are each 1,—A— is —$(CH_2)[m]$—, m is 0–8, preferably 2–8, each $R^{12}$ is H, and one of the $R^{13}$ radicals in each case is H and the other is H or a $C_1$–$C_5$ alkyl; that is wherein $R^{11}$, $R^{13}$, and m have the meanings just given. The most preferred β-hydroxyalkyl amide crosslinking agent is represented by structure (IV) as follows:

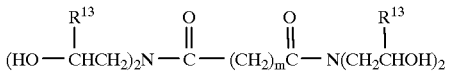

In structure (IV), $R^{13}$ is H or —$CH_3$.

Specific examples of β-hydroxyalkyl amide crosslinking agents are bis[N,N-di(beta-hydroxyethyl)] adipamide, bis[N,N-di(beta-hydroxypropyl)] succinamide, bis[N,N-di(beta-hydroxyethyl)] azelamide, bis[N-N-di(beta-hydroxypropyl)] adipamide, and bis[N-methyl-N-(beta-hydroxyethyl)] oxamide.

The β-hydroxyalkyl amide crosslinking agents are either known compounds or may be prepared by treating an ester with an amine at a temperature in the range of from about ambient to about 200° C. Suitable esters are prepared by esterifying the corresponding acid by standard esterifying procedures. Among the preferred acids used to prepare the β-hydroxyalkyl amide crosslinking agents are oxalic, malonic, succinic, glutaric, adipic, pimelic, suberic, azelaic, sebacic, 1,4-cyclohexane and the like and alkyl derivatives thereof. Dimer and trimer acids may also be used. Suitable amines used to prepare the β-hydroxyalkyl amide crosslinking agents are 2-aminoethanol; 2-methylaminoethanol; 2-ethylaminoethanol; 2-n-propylaminoethanol; 2,2'-iminodiethanol; 2-aminopropanol; 2,2'-iminodiisopropanol; 2-aminocyclohexanol; 2-aminocyclopentanol; 2-aminomethyl-2-methylethanol; 2-n-butylaminoethanol; 2-methylamino-1,2-dimethylethanol; 2-amino-2-methyl-1-propanol; 2-amino-2-methyl-1,3-propanediol; 2-amino-2-ethyl-1,3-propanediol and 2-amino-2-hydroxymethyl-1,3-propanediol. The β-hydroxyalkyl amide crosslinking agents are prepared according to processes described in U.S. Pat. No. 4,076,917 which is hereby incorporated herein by reference.

An aqueous solution containing the crosslinking agent preferably has a pH of from about 1 to about 10, more preferably from about 2 to about 7. Most preferably, the aqueous solution containing the crosslinking agent has a pH of from about 3 to about 5. It is understood that any means of adjusting the pH of the aqueous solution may be employed in the method of the invention to achieve a desired pH.

Optionally, the method of the invention includes a catalyst to speed up the reaction between the crosslinking agent and textile. However, the reaction between the crosslinking agent and textile does not require a catalyst. A catalyst also increases the degree of crosslinking in the reaction between the crosslinking agent and textile. While not wishing to be bound by any theory, the catalyst decreases the zeta potential or the amount of negative charge on the textile surface and thus increases the amount of crosslinker which is deposited on the textile or fabric from the aqueous solution. It is noted in the examples that follow that aluminum potassium sulfate catalyst is more effective at lower concentrations than magnesium chloride catalyst because the $Al^{+3}$ ion is more positive (higher valency) than the $Mg^{+2}$ ion. The higher valency catalyst is more effective at reducing the zeta potential of the textile, thus increasing the amount of crosslinker deposited on the textile from an aqueous solution. Any substance that can accept an electron pair from a base can be used as a catalyst.

Preferably, the catalyst is a Lewis acid catalyst selected from dibutyltindilaurate, iron(III)chloride, scandium(III) trifluoromethanesulfonic acid, boron trifluoride, tin(IV) chloride, $Al_2(SO_4)_3xH_2O$, $MgCl_2.6H_2O$, $AlK(SO_4)_2.10H_2$, and Lewis acids having the formula $MX_n$ wherein M is a metal, X is a halogen atom or an inorganic radical, and n is an integer of from 1 to 4, such as $BX_3$, $AlX_3$, $FeX_3$, $GaX_3$, $SbX_3$, $SnX_4$, $AsX_5$, $ZnX_2$, and $HgX_2$. More preferably, the Lewis acid catalyst is selected from $Al_2(SO_4)_3xH_2O$, $MgCl_2.6H_2O$, $AlK(SO_4)_2.10H_2O$. A combination of catalysts can also be used in the method of the invention.

Any method of applying the crosslinking agent to the textile is acceptable. Preferably, the textile is impregnated with an aqueous solution of the crosslinking agent. As used herein, "impregnate" refers to the penetration of the solution into the fiber matrix of the textile, and to the distribution of the solution in a preferably substantially uniform manner into and through the interstices in the textile. The solution therefore preferably envelopes, surrounds, and/or impregnates individual fibers substantially through the thickness of the textile as opposed to only forming a surface coating on the textile.

In a preferred embodiment of the invention, the aqueous solution of the crosslinking agent is applied to the textile in a textile manufacturing process as part of the durable press finishing operation.

In a another preferred embodiment, where the textile is not treated in a textile manufacturing process, the crosslinking agent is applied in a laundering process, most preferably to rinse water in the rinse cycle of the laundering process at home or at a laundromat.

In a further preferred embodiment, the crosslinking agent is applied by soaking the textile in an aqueous solution containing the crosslinking agent.

In an additional preferred embodiment, the crosslinking agent is applied by spraying an aqueous solution containing the crosslinking agent on a textile and then ironing the textile.

The treated textile is cured at the normal temperatures provided by either a drying unit used in a textile manufacturing process such as a steam heated drying cylinder, an oven, or an iron. Drying temperatures generally range from about 90° C. to about 300° C. Such temperatures permit water to be removed, thereby inducing crosslinking, for example, by means of ether linkages, of the (hydroxyalkyl) urea or β-hydroxyalkyl amide crosslinking agent with the textile. One of the advantages of the crosslinkers of the present invention is that they are stable at elevated temperatures and therefore work particularly well in systems which must be cured at temperatures greater than about 90° C.

The residence time of the textile in the dryer unit, oven, or in contact with an iron ranges from about 1 second to about 200 seconds, depending on the temperature. The actual residence time for a particular textile sample depends on the temperature, pressure, type of fabric, and the type and amount of catalyst. Preferably, the time and temperature required to cure the (hydroxyalkyl)urea or β-hydroxyalkyl amide crosslinking agent with the textile ranges from about 2 to about 60 seconds at a textile temperature ranging from about 100° C. to about 250° C. After the textile with the solution of the crosslinking agent applied thereto is dried/cured, subsequent coatings or additives such as starch is applied.

In a preferred embodiment, a textile treated with the (hydroxyalkyl)urea or β-hydroxyalkyl amide crosslinking agent is ironed both on the inside and outside surfaces to maximize the amount of crosslinking and thus permanent press properties of the textile.

Preferred means of applying the aqueous solution of the crosslinking agent on a textile manufacturing machine are by puddle press, size press, blade coater, speedsizer, spray applicator, curtain coater and water box. Preferred size press configurations include a flooded nip size press and a metering blade size press.

Preferred means of applying the aqueous solution of the crosslinking agent on off-machine coating equipment in a textile manufacturing process are by rod, gravure roll and air knife. The solution may also be sprayed directly onto the textile or onto rollers which transfer the solution to the textile. In an especially preferred embodiment of the invention, impregnation of the textile with the aqueous solution of the crosslinking agent occurs by means of a puddle size press.

Preferred means of applying the aqueous solution of the crosslinking agent in a laundering process are by adding the solution to the rinse water during the rinse cycle in the laundering process. In an especially preferred embodiment of the invention, impregnation of the textile with the aqueous solution of the crosslinking agent occurs during the final rinse cycle in a laundering process. In an additional especially preferred embodiment of the invention, impregnation of the textile with the aqueous solution of the crosslinking agent occurs in a washing machine which contains at least one textile, the crosslinker and optionally a catalyst, wherein the washing machine is not operating so that the textile remains in contact with the treatment solution for a period of time to facilitate the impregnation of the treatment solution into the textiles. The washing machine is turned on to the spin cycle, the textiles are removed, dried and ironed.

Another preferred means of applying the aqueous solution of the crosslinking agent to a textile such as clothing is spraying by means of a pump or aerosol a solution of the crosslinking onto the textile and then ironing the textile.

The concentration of the (hydroxyalkyl)urea or β-hydroxyalkyl amide crosslinking agent in the aqueous solution is sufficient to provide from about 0.1 to about 10 weight percent of (hydroxyalkyl)urea or β-hydroxyalkyl amide in the textile based on the oven-dry weight of the textile. Preferably, the concentration of the crosslinking agent in the aqueous solution is sufficient to provide from about 1 to about 5 weight percent, more preferably from about 2 to about 4 weight percent of (hydroxyalkyl)urea or β-hydroxyalkyl amide in the textile based on the oven-dry weight of the textile.

Referring to the drawings, on the left in FIG. 1 is a photomicrograph of a T-shirt pretreated with an aqueous solution containing the (hydroxyalkyl)urea crosslinking agent of the invention and catalyst wherein the T-shirt was dried and then washed using detergent. On the right in FIG. 1 is a photomicrograph of a T-shirt treated in an identical manner except that no (hydroxyalkyl)urea crosslinking agent was present in the water.

The method of the present invention provides permanent press properties to textiles treated therewith and increases the resistance of such textiles to future laundering abrasion. Such treated textiles display a significant reduction in wrinkles compared with nontreated textiles. Moreover, the treated textiles have a tactile sensation of feeling soft and retain their smoothness even laundering.

The following nonlimiting examples illustrate further aspects of the invention.

EXAMPLE 1

Synthesis of Hydroxyethylurea Crosslinking Agent.

105 grams of diethanolamine and 60 grams of urea were charged into a 1 L flask equipped with a heating mantle, thermometer and stirrer and allowed to react at 115° C. for 8 hours. A nitrogen purge was used to remove evolving ammonia. The progress of reaction was monitored by amine titration. A clear, hygroscopic liquid was obtained which contained N,N-bis(2-hydroxyethyl)urea.

EXAMPLES 2–7

Synthesis of Hydroxyalkylurea Crosslinking Agents.

The following amines were reacted with urea according to the procedure set forth in Example 1.

| Example | Amine | Wt, (gram) | Urea, (gram) |
|---|---|---|---|
| 2 | ethanolamine | 122 | 60 |
| 3 | diethanolamine | 210 | 60 |
| 4 | ethanolamine<br>diethanolamine | 61<br>105 | 60 |
| 5 | 3-amino-1-propanol | 150 | 60 |
| 6 | 2-amino-2-ethyl-1,3-propanediol (AEPD) | 119 | 30 |
| 7 | 4-aminobutanol | 12 | 4 |

EXAMPLE 8

100 grams of diethanolamine in 100 grams of water was neutralized with concentrated hydrochloric acid. 77.2 grams of potassium cyanate were added and the mixture heated to 90° C. for 2 hours. After cooling to ambient temperature, potassium chloride was precipitated by addition of 200 ml of ethanol. The salt was filtered out and the final product was obtained upon removal of water and ethanol by rotary evaporation. The product was a hygroscopic liquid containing N,N-bis(2-hydroxyethyl)urea, which could be used as a crosslinker without further purification.

EXAMPLE 9

105 grams of diethanolamine and 90 grams of dimethylcarbonate were charged to a flask equipped with a heating mantle, stirrer, and condenser. The flask contents were heated to 80° C. and allowed to stir for 3 hours. Volatile byproducts, e.g., methanol, were removed by vacuum distillation. A mixture containing N,N-bis(2-hydroxyethyl)urea was obtained. EXAMPLE10

Using the procedure as set forth in Example 1, the reaction also can be conducted effectively using refluxing water as a means of removing evolved ammonia. 105 grams of diethanolamine, 25 grams of water and 60 grams of urea were charged in a 1 L flask equipped with heating mantle, thermometer and stirrer and allowed to react at 115° C. for 8 hours.

EXAMPLE 11

Using the procedure as set forth in Example 9, 210 grams of diethanolamine was reacted with 90 grams of dimethyl carbonate. A mixture was obtained containing tetrakis(2-hydroxyethyl)urea.

EXAMPLE 12

Using the procedure as set forth in Example 9, 122 grams of ethanolamine was reacted with 90 grams of dimethyl carbonate. A mixture was obtained containing N,N'-bis(2-hydroxyethyl)urea.

EXAMPLE 13

Cotton swatches, 4"×6.5" were soaked for 10 minutes in varying concentrations as set forth in Table I of N,N-bis (hydroxyethylurea) which was prepared in Example 10 and $MgCl_2.6H_2O$ in aqueous solution. A control swatch was presoaked with water without the N,N-bis (hydroxyethylurea) crosslinking agent or catalyst. The swatches were ironed at high heat until dry. The swatches were washed separately in a TERG-O-TOMETER under the following wash conditions: 1 L 110 ppm hardness water (2:1 $CaCl_2$ to $MgCl_2$). 94° C., 0.9 g/l AATCC standard detergent, 10 minute wash, 3 minute rinse. The swatches were squeezed tightly and dried in a commercial clothes dryer using the "normal" setting for 20 minutes. The swatches were laid on a flat surface and the major folds were removed, but no attempt was made to stretch the fabric. The swatches were evaluated for wrinkles on a subjective scale of 1 to 5 wherein 1 signified very few wrinkles and 5 signified a majority of wrinkles. The test results are summarized in Table I.

TABLE I

Permanent Press Finishing on Cotton Swatches.

| Swatch # | N,N-bis(hydroxyethylurea) wt. % | $MgCl_2$ $6H_2O$ wt. % | Visual Rating | Result |
|---|---|---|---|---|
| Control | 0 | 0 | 5 | very wrinkled |
| 1 | 4 | 2.5 | 5 | very wrinkled |
| 2 | 8 | 2.5 | 4 | a few large wrinkles |
| 3 | 8 | 5 | 3 | less wrinkled than 2 |
| 4 | 12 | 2.5 | 1 | least wrinkled |
| 5 | 4 | 5 | 2 | 2nd least wrinkled |

The test results in Table I show that the cotton swatches pretreated with the (hydroxyalkyl)urea crosslinking agents of the invention and catalyst were singnificantly less wrinkled after washing than the control swatch which was not pretreated with the the (hydroxyalkyl)urea crosslinking agents. It is noted that the least wrinkled swatch was treated with a solution in which the concentration of the (hydroxyalkyl)urea crosslinking agent was 12 weight percent and the $MgCl_2$ was at 2.5%. In addition, it was observed that the swatches treated with the (hydroxyalkyl)urea crosslinking agents felt softer than the control swatch.

EXAMPLE 14

A white cotton T-shirt was treated with 5% N,N-bis (hydroxyethylurea) prepared in Example 1 and 2.5% $MgCl_2$ solution. The T-shirt was soaked in the solution for 10 minutes, the excess solution was wrung out, and the T-shirt was dried in a clothes dryer for 20 to 30 minutes. After drying, the T-shirt was ironed at high heat on the inside surface as well as the outside. The T-shirt was washed in a commercial washing machine set on "whites", which meant a hot wash and cold rinse. The detergent used was the AATCC standard at 0.9 g/L. A control which was an identical T-shirt was presoaked with water without the N,N-bis(hydroxyethylurea) and washed in a similar manner.

After washing, the T-shirts were dried in separate dryers for 20 to 30 minutes. The T-shirts were put on wire clothes hangers for inspection (FIG. 1). The T-shirt treated with the N,N-bis(hydroxyethylurea) had few to no wrinkles. The control T-shirt (untreated) was very wrinkled.

EXAMPLE 15

Cotton swatches, 12"×12" were soaked for 10 minutes in varying concentrations as set forth in Table II of N,N-bis (hydroxyethylurea) which was prepared in Example 1 and $MgCl_2$ $6H_20$ in aqueous solution. A control swatch was presoaked with water without the N,N-bis (hydroxyethylurea) crosslinking agent or catalyst. The swatches were ironed at high heat until dry. The swatches were washed separately in a TERG-O-TOMETER under the following wash conditions: 1 L 110 ppm hardness water (2:1 $CaCl_2$ to $MgCl_2$), 93.4° C., 0.9 g/l AATCC standard detergent, 10 minute wash, 3 minute rinse. The swatches were squeezed tightly and dried in a commercial clothes dryer using the "normal" setting for 20 minutes. The swatches were laid on a flat surface and the major folds were removed, but no attempt was made to stretch the fabric. The swatches were evaluated for wrinkles on a subjective scale of 1 to 5 wherein 1 signified very few wrinkles and 5 signified a majority of wrinkles. The test results are summarized in Table II.

TABLE II

Permanent Press Finishing on Cotton Swatches.

| Swatch # | N,N-bis(hydroxyethylurea) wt. % | $MgCl_2$ .$6H_2O$ wt. % | Visual Rating |
|---|---|---|---|
| Control | 0 | 0 | 5 |
| 6 | 12 | 2.5 | 2 |
| 7 | 8 | 5 | 4 |
| 8 | 4 | 5 | 3 |
| 9 | 2.4 | 20 | 2 |
| 10 | 2.4 | 10 | 1 |

The test results in Table II show that the cotton swatches pretreated with the (hydroxyalkyl)urea crosslinking agents of the invention and catalyst were significantly less wrinkled after washing than the control swatch which was not pretreated with the (hydroxyalkyl)urea crosslinking agents. It is noted that the least wrinkled swatch was treated with a solution in which the concentration of the (hydroxyalkyl) urea crosslinking agent was 2.4 weight percent and the $MgCl_2.6H_2O$ was at 10 weight percent.

EXAMPLE 16

Cotton swatches, 12"×12" were soaked for 10 minutes in varying concentrations as set forth in Table lll of N,N-bis (hydroxyethylurea) which was prepared in Example 1 and aluminum potassium sulfate ($AIK(SO_4)_2.12H_2O$ in aqueous solution. A control swatch was presoaked with water without the N,N-bis(hydroxyethylurea) crosslinking agent or catalyst. The swatches were ironed at high heat until dry. The swatches were washed separately in a TERG-O-TOMETER under the following wash conditions: 1 L 110 ppm hardness water (2:1 $CaCl_2$ to $MgCl_2$), 93.4° C., 0.9 g/l AATCC standard detergent, 10 minute wash, 3 minute rinse. The swatches were squeezed tightly and dried in a commercial clothes dryer using the "permanent press" setting for 20 minutes. It is noted that three cotton towels were used as a ballast in the drier to prevent the swatches from collecting at the drier vent. The swatches were laid on a flat surface and the major folds were removed, but no attempt was made to stretch the fabric. The swatches were evaluated for wrinkles on a subjective scale of 1 to 5 wherein 1 signified very few wrinkles and 5 signified a majority of wrinkles. The test results are summarized in Table III.

TABLE III

Permanent Press Finishing on Cotton Swatches.

| Swatch # | N,N-bis(hydroxyethylurea) wt. % | AIK $(SO_4)_2$ .$12H_2O$ wt. % | Visual Rating | Result |
|---|---|---|---|---|
| Control | 0 | 0 | 5 | very wrinkled |
| 11 | 10 | 3 | 3 | some wrinkles |
| 12 | 5 | 3 | 4 | few wrinkles |
| 13 | 10 | 1 | 2 | few wrinkles |
| 14 | 3 | 3 | 1 | very few wrinkles |

The test results in Table III show that the cotton swatches pretreated with the (hydroxyalkyl)urea crosslinking agents of the invention and catalyst were significantly less wrinkled after washing than the control swatch which was not pretreated with the (hydroxyalkyl)urea crosslinking agents. The test results in Table III show that the swatch treated with 1 weight percent crosslinking agent was extremely wrinkle free which indicates that even lower levels of crosslinking agent may be used thus rendering the treatment economical for use in the rinse cycle of a washing machine.

It is noted that the aluminum potassium sulfate catalyst was more efficient at lower concentrations than the magnesium chloride catalyst which was used in Examples 13 and 15. While not wishing to be bound by any theory, the present inventors believe that this is because the $Al^{+3}$ ion is more positive than the $Mg^{+2}$ ion permitting the use of lower concentrations of catalyst and crosslinking agent.

While the invention has been described with particular reference to certain embodiments thereof, it will be understood that changes and modifications may be made by those of ordinary skill in the art within the scope and spirit of the following claims.

What is claimed is:

1. A method for imparting permanent press properties to a textile containing cellulose fibers wherein said method comprises applying an aqueous solution of a formaldehyde-free crosslinking agent to a textile, and heating the textile at a sufficient temperature for a sufficient time to react the crosslinking agent with the textile wherein water is removed from the textile, to impart permanent press properties to the textile, wherein the crosslinking agent is selected from the group consisting of (hydroxyalkyl)urea, β-hydroxyalkylamide and combinations thereof, wherein the (hydroxyalkyl)urea has the structure

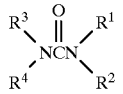

wherein $R^1$ is

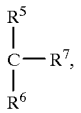

$R^2$ is H or $R^5$, $R^3$ is H or $R^5$, and $R^4$ is H, $R^1$, or $R^5$, wherein $R^5$ is

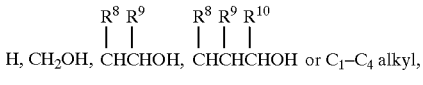

$R^6$ is

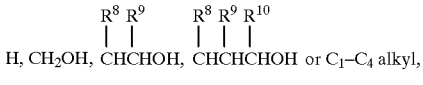

and $R^7$ is

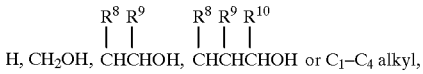

wherein $R^8$ is H, methyl or ethyl, $R^9$ is H, methyl or ethyl, and $R^{10}$ is H, methyl or ethyl; and the β-(hydroxyalkyl)urea has the structure

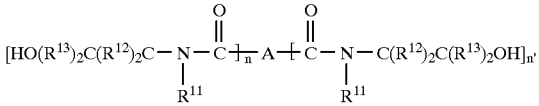

wherein A is a bond, hydrogen, a monovalent or polyvalent organic radical derived from a saturated or unsaturated alkyl containing from 1 to 60 carbon atoms, aryl, tri-lower alkyleneamino or an ethylenically unsaturated radical; $R^{11}$ is selected from the group consisting of hydrogen, lower alkyl having 1 to 5 carbon atoms, and hydroxyalkyl having from 1 to 5 carbon atoms; $R^{12}$ and $R^{13}$ are independently selected from the group consisting of hydrogen, straight or branched chain lower alkyl having from 1 to 5 carbon atoms, and one of the $R^{12}$ and $R^{13}$ radicals joined together with the carbon atoms to which they are attached to form a cycloalkyl; n is an integer of 1 or 2 and n' is an integer of 0 to 2; n being 2 when n' is 0.

2. The method according to claim 1 wherein the cellulosic textiles are selected from the group consisting of cotton, rayon, linen, polyester/cotton, polyester/rayon, and combinations thereof.

3. The method according to claim 2 wherein the cellulosic textile is cotton.

4. The method according to claim 1 wherein said (hydroxyalkyl)urea crosslinking agent is selected from the group consisting of N,N-bis(2-hydroxyethyl)urea, tetrakis (2-hydroxyethyl)urea, tris(2-hydroxyethyl)urea, N,N'-bis(2-hydroxyethyl)urea, N,N'-bis(3-hydroxypropyl)urea, N,N'-bis(4-hydroxybutyl)urea, 2-urea-2-ethyl-1,3-propanediol, and combinations thereof.

5. The method according to claim 4 wherein said (hydroxyalkyl)urea crosslinking agent is selected from the group consisting of N,N'-bis(2-hydroxyethyl)urea and N,N'-bis(3-hydroxypropyl)urea.

6. The method according to claim 1 wherein said β-hydroxyalkylamide crosslinking agent has the structure

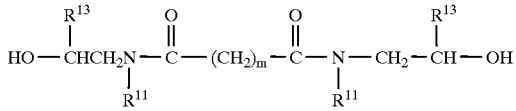

wherein m is 0 to 8; $R^{11}$ is selected from the group consisting of hydrogen, lower alkyl having 1 to 5 carbon atoms, and hydroxyalkyl having from 1 to 5 carbon atoms; and $R^{13}$ is selected from hydrogen or straight or branched chain lower alkyl having from 1 to 5 carbon atoms.

7. The method according to claim 6 wherein said β-hydroxyalkylamide crosslinking agent has the structure

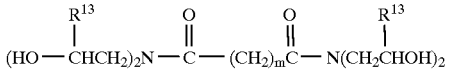

wherein $R^{13}$ is hydrogen or methyl.

8. The method according to claim 1 wherein said β-hydroxyalkylamide crosslinking agent is selected from the group consisting of bis[N,N-di(beta-hydroxyethyl)] adipamide, bis[N,N-di(beta-hydroxypropyl)] succinamide, bis[N,N-di(beta-hydroxyethyl)] azelamide, bis[N-N-di (beta-hydroxypropyl)] adipamide, and bis[N-methyl-N-(beta-hydroxyethyl)] oxamide.

9. The method according to claim 1 further comprising the step of adding a Lewis acid catalyst either to the aqueous solution of the crosslinking agent or to the textile.

10. The method according to claim 9 wherein the Lewis acid catalyst is selected from the group consisting of dibutyltindilaurate, iron(III)chloride, scandium(III) trifluoromethanesulfonic acid, boron trifluoride, tin(IV) chloride, $Al_2(SO_4)_3xH_2O$, $MgCl_2.6H_2O$, $AlK(SO_4)_2.10H_2O$, and $BX_3$, $AlX_3$, $FeX_3$, $GaX_3$, $SbX_3$, $SnX_4$, $AsX_5$, $ZnX_2$, $HgX_2$, wherein X is a halogen atom or an inorganic radical.

11. The method according to claim 10 wherein the Lewis acid catalyst is selected from the group consisting of $Al_2(SO_4)_3xH_2O$, $MgCl_2.6H_2O$, $AlK(SO_4)_2.10H_2O$.

12. The method according to claim 1 wherein the concentration of the (hydroxyalkyl)urea or β-hydroxyalkylamide crosslinking agent in the aqueous solution is sufficient to provide from about 0.1 to about 10 weight percent of (hydroxyalkyl)urea or β-hydroxyalkylamide in the textile based on the oven-dry weight of the textile.

13. The method according to claim 12 wherein the concentration of the (hydroxyalkyl)urea or β-hydroxyalkylamide crosslinking agent in the aqueous solution is sufficient to provide from about 1 to about 5 weight percent of (hydroxyalkyl)urea or β-hydroxyalkylamide in the textile based on the oven-dry weight of the textile.

14. The method according to claim 1 wherein the aqueous solution containing the crosslinking agent has a pH of from about 1 to about 10.

15. The method according to claim 14 wherein the aqueous solution containing the crosslinking agent has a pH of from about 2 to about 7.

16. The method according to claim 15 wherein the aqueous solution containing the crosslinking agent has a pH of from about 3 to about 5.

17. A textile treated with the crosslinking agent according to claim 1.

18. A method for imparting permanent press properties to a textile containing cellulose fibers wherein said method comprises adding either an aqueous solution of a formaldehyde-free crosslinking agent or a neat formaldehyde-free crosslinking agent to a laundering process comprising at least one textile, and heating the textile at a sufficient temperature for a sufficient time to react the crosslinking agent with the textile wherein water is removed from the textile, to impart permanent press properties to the textile, wherein the crosslinking agent is selected from the group consisting of (hydroxyalkyl)urea, β-hydroxyalkylamide and combinations thereof, wherein the (hydroxyalkyl)urea has the structure

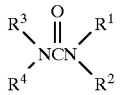

wherein $R^1$ is

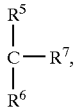

$R^2$ is H or $R^5$, $R^3$ is H or $R^5$, and $R^4$ is H, $R^1$, or $R^5$, wherein $R^5$ is

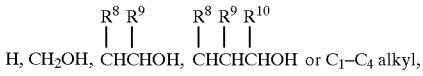

$R^6$ is

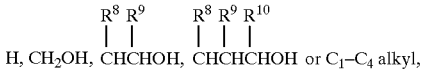

and $R^7$ is

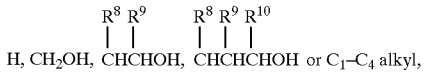

wherein $R^8$ is H, methyl or ethyl, $R^9$ is H, methyl or ethyl, and $R^{10}$ is H, methyl or ethyl; and the β-hydroxyalkylamide has the structure

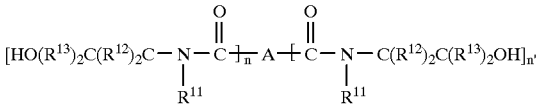

wherein A is a bond, hydrogen, a monovalent of polyvalent organic radical derived from a saturated or unsaturated alkyl containing from 1 to 60 carbon atoms, aryl, tri-lower alkyleneamino or an ethylenically unsaturated radical; $R^{11}$ is selected from the group consisting of hydrogen, lower alkyl having 1 to 5 carbon atoms, and hydroxyalkyl having from 1 to 5 carbon atoms; $R^{12}$ and $R^{13}$ are independently selected from the group consisting of hydrogen, straight or branched chain lower alkyl having from 1 to 5 carbon atoms, and one of the $R^{12}$ and $R^{13}$ radicals joined together with the carbon atoms to which they are attached to form a cycloalkyl; n is an integer of 1 or 2 and n' is an integer of 0 to 2; n being 2 when n' is 0.

19. The method according to claim 18 wherein the crosslinking agent is added to rinse water during the rinse cycle of the laundering process.

20. The method according to claim 18 further comprising the step of adding a Lewis acid catalyst either to the aqueous solution of the crosslinking agent or to the laundering process.

21. The method according to claim 20 wherein the Lewis acid catalyst is added to rinse water during the rinse cycle of the laundering process.

22. A textile treated with the crosslinking agent according to claim 18.

* * * * *